United States Patent [19]

Kinoshita et al.

[11] Patent Number: 4,595,375

[45] Date of Patent: Jun. 17, 1986

[54] IMAGING AND STREAKING TUBES, AND METHODS FOR FABRICATING THE IMAGING AND STREAKING TUBES

[75] Inventors: Katsuyuki Kinoshita; Yoshiji Suzuki, both of Hamamatsu, Japan

[73] Assignee: Hamamatsu Photonics Kabushiki Kaisha, Shizuoka, Japan

[21] Appl. No.: 551,835

[22] Filed: Nov. 15, 1983

[30] Foreign Application Priority Data

Nov. 24, 1982 [JP] Japan ..... 57-205769
Sep. 6, 1983 [JP] Japan ..... 58-163940

[51] Int. Cl.[4] ..... H01J 9/233
[52] U.S. Cl. ..... 445/14; 445/51
[58] Field of Search ..... 445/10, 12, 14, 51, 445/52

[56] References Cited

U.S. PATENT DOCUMENTS

| | | | |
|---|---|---|---|
| 2,153,616 | 4/1939 | Diels | 445/14 X |
| 2,231,698 | 2/1941 | Zworykin et al. | 250/175 |
| 2,752,519 | 6/1956 | Ruedy | 445/14 X |
| 3,043,974 | 7/1962 | McGee | 445/14 X |
| 3,084,010 | 4/1963 | Turnbull | 445/14 |

*Primary Examiner*—Kenneth J. Ramsey
*Attorney, Agent, or Firm*—Spencer & Frank

[57] ABSTRACT

An imaging tube for amplifying and observing a diminished light image and a streaking tube for analyzing the light intensity distributions of light sources with elapsing of time. In order to avoid adhesion of alkali metal to the micro-channel-plate in fabrication of the imaging tube and to avoid adhesion of alkali metal to the deflection electrode in the streaking tube, a separation wall and a lid movable on the separation wall are used.

4 Claims, 10 Drawing Figures

IMAGING AND STREAKING TUBES, AND METHODS FOR FABRICATING THE IMAGING AND STREAKING TUBES

BACKGROUND OF THE INVENTION

The present invention relates to an imaging tube which can favorably be used to amplify and observe a diminished-light image, to a streaking tube which can favorably be used to analyze the light intensity distributions of light sources with elapsing of time, and to a method of fabricating these types of imaging and streaking tubes.

The configuration of the conventional imaging tube and the problems to be solved in accordance with the present invention will be described in relation to FIG. 1.

FIG. 1 shows a cross-sectional view of the conventional imaging tube together with the interrelation between the photoelectric layer and optical image.

One end of a vacuum envelope 3 of the imaging tube constitutes an incident window 1 upon which the optical image to be analyzed can be incident, and another end constitutes a light emitting window 2 from which the processed optical image can be emitted. Photoelectric layer 4, focusing electrode 6, aperture electrode 7, micro-channel-plate 8, and phosphor layer 9 are, in sequence, arranged in a space between incident window 1 and light emitting window 2 along the tube axis of vacuum envelope 3. A higher DC voltage is applied to focusing electrode 6 with respect to photoelectric layer 4, and another higher DC voltage to aperture electrode 7 with respect to focusing electrode 6. A DC voltage which is the same as or a little higher than that applied to aperture electrode 7 is applied to input electrode 8*a* of micro-channel-plate 8, and a higher DC voltage than that applied to input electrode 8*a* is applied to output electrode 8*b* of micro-channel-plate 8. A further higher DC voltage than that applied to output electrode 8*b* of micro-channel-plate is applied to phosphor layer 9.

We assume that optical image 4*a* is incident onto photoelectric layer 4 via incident window 1 in the setup not shown. Photoelectric layer 4 emits an electron image corresponding to the optical image, and the emitted electrons are accelerated and focused by focusing electrode 6. They pass through both aperture electrode 7 and micro-channel-plate 8, and arrive at phosphor layer 9 to be focused thereon.

Micro-channel-plate 8 consists of a strand of approximately $10^6$ fine glass tubes each having a secondary electron emitting surface of lead oxide deposited on its inner wall. Each fine glass tube, having an inner diameter of 15 μm, is 0.9 mm long. The strand has a diameter of 25 mm.

The incident electrons are multiplied by the micro-channel-plate 8 and then the multiplied electrons are emitted from the micro-channel-plate 8. The multiplication factor depends on the voltage difference between input electrode 8*a* and output electrode 8*b*. When the voltage difference between input electrode 8*a* and output electrode 8*b* changes from 1.3 kV to 1.9 kV, the multiplication factor goes from $10^3$ to $3\times10^6$.

Such an imaging tube as described above can be fabricated by the following method.

At first, a glass cylinder to form the wall of vacuum envelope 3 and one end of vacuum envelope 3 are constructed. Next, a first glass disc for forming a photoelectric layer on which the optical image is incident, and the other end of vacuum envelope 3 are constructed. Materials used for the envelope, i.e., a second glass disc wherein a light emitting window used to emit the optical image therefrom is formed and whereon the phosphor layer is formed, and elements used for making such electrodes as mesh electrode 5, focusing electrode 6, aperture electrode 7, and micro-channel-plate 8 are prepared. Elements used for making the electrodes are then fastened within the glass cylinder. At that time, antimony metal contained within a tungsten coil to form an evaporation source of antimony is located against the photoelectric layer substrate.

Phosphor materials are coated on one surface of the second glass disc. First and second glass discs are located at the appropriate ends of the glass cylinder, and then the resulting envelope is exhausted to obtain a vacuum.

A branching tube is fastened to the side wall of the sealed envelope and an alkaline metal source is housed in this branching tube. Air is then exhausted from the sealed envelope via the exhausting tube attached thereto.

A current is applied to flow through the tungsten coil so that antimony metal is deposited onto the photoelectric layer substrate. Alkali metal is gradually fed from the branching tube into the envelope, while the sensitivity of the photoelectric layer is being monitored, until the maximum sensitivity can be obtained. Thereafter, the branching tube is cut off. Then, the exhausting tube is also cut away to complete the imaging tube.

It can easily be understood from the description of the fabrication method that a small amount of alkali metal necessarily adheres to each electrode while alkali metal is being fed to the sealed envelope.

When an imaging tube fabricated in accordance with this process is operated, the phosphor layer sometimes emits light due to a decrease in the work function by the alkali metal when no light is incident upon the photoelectric layer.

When a high voltage is applied to microchannel-plate 8, this mode of light emission is especially enhanced.

This mode of light emission causes the S/N ratio to decrease affecting the background noise for the image, and it makes the dynamic range low.

The inventors of the present invention found that the phosphor layer emitted light without any incident light when a voltage was applied only to the phosphor layer of the micro-channel-plate unless voltages were applied to the imaging section consisting of a photoelectric layer, a focusing electrode, and an aperture electrode. They also found that the objectionable light emission was caused by existence of the micro-channel-plate. Furthermore, they found that the background sensitivity was not increased when a set of voltage was applied to the respective electrodes after the envelope was exhausted and sealed for making a tube of the same dimensions providing no photoelectric alkali layer. The above phenomena suggests that generated electrons increase the background sensitivity due to the following reasons:

Alkali metal adheres to the inner surface of the micro-channel-plate which multiplies secondary electrons, while the photoelectric layer is being formed, and it decreases the work function of electrons at the surface. When a voltage is applied to the micro-channel-plate during operation, high electric fields are locally generated at microscopic locations of non-uniform areas on the inner surface thereof. Interaction of both the low work functon and high electric field causes the inner surface of the micro-channel-plate to emit electrons.

Electrons generated due to field emission are multiplied by the micro-channel-plate and incident upon the phosphor layer to cause the unwanted background sensitivity to increase.

The streaking tube can convert the incident light pulse with a duration of 1 ns into a length on the order of several tens of millimeters on the phosphor layer, and it has an excellent timing resolution of 2 pico seconds or less. The streaking tube is thus widely used for analyzing the waveforms of the laser pulses.

Next, the streaking tube in accordance with the present invention will be described hereafter.

The configuration of the conventional streaking tube and the problems to be solved in accordance with the present invention will briefly be described in relation to FIG. 2.

FIG. 2 shows a cross-sectional view of the conventional streaking tube together with the interrelation between the photoelectric layer and optical image.

One end of a vacuum envelope 3 of the streaking tube constitutes an incident window 1 upon which the optical image to be analyzed can be incident, and another end constitutes a light emitting window 2 from which the processed optical image can be emitted. Photoelectric layer 4, mesh electrode 5, focusing electrode 6, aperture electrode 7, deflection electrode 108, and phosphor layer 9 are, in sequence, arranged in a space between incident window 1 and light emitting window 2 along the tube axis of vacuum envelope 3. A higher DC voltage is applied to mesh electrode 5 with respect to photoelectric layer 4, another higher DC voltage to focusing electrode 6 with respect to mesh electrode 5, and a further higher DC voltage to aperture electrode 7 with respect to focusing electrode 6. A DC voltage which is the same as or a little higher than that applied to aperture electrode 7 is applied to phosphor layer 9.

We assume that linear optical image 4*a* which lies in the center of the photoelectric layer 4 is incident onto photoelectric layer 4 via incident window 1 in the setup not shown. Photoelectric layer 4 emits an electron image corresponding to the optical image, and the emitted electrons are accelerated by mesh electrode 5 and focused by focusing electrode 6. They pass through both aperture electrode 7 and deflection electrode 108 and arrive at phosphor layer 9 to be focused thereon.

While the linear electronic image is passing through a gap within deflection electrode 108, a deflection voltage is applied to the deflection electrode 108. The electric field caused by this deflection voltage is normal to both the tube axis and linear electronic image. (Note that the electric field is normal to the plane of the drawing in FIG. 2.) The field strength is proportional to the deflection voltage. The electron beam on phosphor layer 9 travels normal to the linear electronic image when scanned. A series of sequential linear optical images are arranged onto photoelectric layer 4 in a direction perpendicular to the linear images, and thus a streaking image is formed. Brightness changes in the direction that a series of linear optical images are arranged or that scanning is being carried out indicates a change in intensity of the optical image incident on phosphor layer 4.

Such a streaking tube as described above can be fabricated by the following method:

At first, a glass cylinder to form the wall of vacuum envelope 3 and one end of vacuum envelope 3 are constructed. Next, a first glass disc for forming a photoelectric layer on which the optical image is incident, and the other bottom of vacuum envelope 3 are constructed. Materials used for the envelope, i.e., a second glass disc wherein a light emitting window used to emit the optical image therefrom is formed and whereon the phosphor layer is formed, and elements used for making such electrodes as mesh electrode 5, focusing electrode 6, aperture electrode 7, and deflection electrode 108 are prepared. Elements used to make the electrodes are then fastened within the glass cylinder. At that time, antimony metal contained within a tungsten coil to form an evaporation source of antimony is located against the photoelectric layer substrate.

Phosphor materials are coated on one surface of the second glass disc. First and second glass discs are located at the appropriate ends of the glass cylinder, and then the resulting envelope is exhausted to obtain a vacuum.

A branching tube is then fastened to the side wall of the sealed envelope and an alkaline metal source is housed in this branching tube. Air is exhausted from the sealed envelope via the exhausting tube attached thereto.

A current is applied to flow through the tungsten coil so that antimony metal is deposited onto the photoelectric layer substrate. Alkali metal is gradually fed from the branching tube to the envelope, while the sensitivity of the photoelectric layer is being monitored, until the maximum sensitivity is obtained. Thereafter, the branching tube is cut off. Thereafter, the exhausting tube is cut away to complete the streaking tube.

It can easily be understood from the description of the fabrication method that a small amount of alkali metal necessarily adheres to each electrode while alkali metal is being fed to the sealed envelope.

When a streaking tube fabricated in accordance with this process is operated, the phosphor layer sometimes emits light due to a decrease in the work function by the alkali metal when no light is incident upon the photoelectric layer.

When an RF voltage is repetitively applied to deflection electrode 108, this mode of light emission is especially enhanced.

This mode of light emission causes the S/N ratio to decrease affecting the background noise for the streaking image, and it makes the dynamic range low.

The inventors of the present invention studied the photoelectrons, on the photoelectric layer, which were generated due to light emitted by excitation or ionization of gaseous molecules or atoms which had collided with electrons, or by collision of electrons or ions with the sealed envelope, and they found that the main reason for their generation was caused by the effect of the deflection electrode on the dynamic range.

We found that, unless a voltage was applied across a pair of deflection electrodes although a high DC voltage was applied across photoelectric layer 4 and aperture electrode 7, light emission occurring in phosphor layer 9 was diminished in intensity while enhanced by the repetitive sweep voltage applied across the deflection electrode.

SUMMARY OF THE INVENTION

An objective of the present invention is to provide an imaging tube which is free from an unwanted light emission as explained before.

In order to practice this objective of the present invention, the imaging tube provides a micro-channel-plate to multiply photoelectrons emitted from the photoelectric layer thereof and to observe the diminished light image obtained by the multiplied photoelectrons. It consists of a separation wall with a window on the tube axis, arranged at or near the crossover point of photoelectrons between the photoelectric layer and micro-channel-plate, a lid movable between the positions to close and open the window, and means to move the lid into the open position; and it is characterized in that the lid is opened to form a path along which electrons can move during operation and is closed only while the photoelectric layer is being formed.

A secondary objective of the present invention is to present a method of fabricating the imaging tube.

In order to practice the secondary objective of the present invention, the method of fabricating the imaging tube providing the micro-channel-plate to multiply photoelectrons emitted from the photoelectric layer and to observe the diminished light image obtained by the multiplied photoelectrons consists of an assembling process providing a lid to separate first a space including at least one surface, to form a photo electric layer thereon with the envelope kept in a vacuum after the envelope is exhausted, and a focusing electrode from a second space including at least a micro-channel-plate and a phosphor layer when the opening is arranged on the tube axis at or near the crossover point of photoelectrons on the separation wall of the envelope, and to close the opening during fabrication; an exhausting process to exhaust the first and second spaces; a photoelectric layer forming process to form a photoelectric layer while introducing alkali metal to form the photoelectric layer via the branching tube into the first space; an ejection process to cut the branching tube, to exhaust the envelope while the envelope is being heated, and to eject the photoelectric layer forming marterials which do not contribute to formation of the photoelectric layer; and a removing process to remove the lid from the opening after completion of exhausting operations.

The first space is designed to be filled with alkali metal vapor for forming the photoelectric layer during fabrication, and the second space is designed to protect the micro-channel-plate against covering of alkali metal vapor during this period of time.

By connecting the first space providing the photoelectric layer with a minimum opening to the second space providing the micro-channel-plate during operation, travelling of alkali metal is suppressed during operation.

The micro-channel-plate is not designed to be contaminated by residual alkali metal during operation.

Even if light emission has occurred due to ionization near the micro-channel-plate or due to collision of electrons at the inner wall of the sealed envelope, the micro-channel-plate is designed so that the incident light does not arrive at the photoelectric layer and this prevents the phosphor layer from emitting unwanted light emission.

A third objective of the present invention is to present a streaking tube which is free from unwanted light emission as described before.

In order to practice this third objective of the present invention, the streaking tube uses a deflection electrode to scan photoelectrons emitted from the photoelectric layer thereof and to observe the diminished light image obtained by the deflected photoelectrons. It consists of a separation wall with a window on the tube axis, arranged at or near the cross over point of photoelectrons between the photoelectric layer and the deflection electrode, a lid movable between the positions to close and open the window, and means to move the lid into the open position; and it is characterized in that the lid is opened to form a path along which electrons can move during operation and is closed only while the photoelectric layer is being formed.

A fourth objective of the present invention is to present a method of fabricating the streaking tube.

In order to practice this fourth objective of the present invention, the method of fabricating the streaking tube using a deflection electrode to deflect photoelectrons emitted from the photoelectric layer and to observe the diminished light image obtained by the deflected photoelectrons consists of an assembling process providing a lid to separate a first space including at least one surface, to form a photoelectric layer thereon within the envelope kept in a vacuum after the envelope is exhausted, and a focusing electrode from a second space including at least a deflection electrode and a phosphor layer when the opening is arranged on the tube axis at or near the crossover point of photoelectrons on the separation wall of the envelope, and to close the opening during fabrication; an exhausting process to exhaust the first and second spaces; a photoelectric layer forming process to form a photoelectric layer while introducing alkali metal to form the photoelectric layer via the branching tube into the first space; an ejection process to cut the branching tube, to exhaust the envelope while the envelope is being heated, and to eject the photoelectric layer forming materials which do not contribute to forming the photoelectric layer; and a removing process to remove the lid from the opening after completion of exhausting operations.

The first space is designed to be filled will alkali metal vapor for forming the photoelectric layer during fabrication, and the second space is designed to protect the deflection electrode against the covering of alkali metal vapor during this period of time.

By connecting the first space providing the photoelectric layer with a minimum opening to the second space providing the deflection electrode during operation, travelling of alkali metal is suppressed during operation.

The deflection electrode is not designed to be contaminated by residual alkali metal during operation.

Even if light emission has occurred due to ionization near the deflection electrode or due to collision of electrons at the inner wall of the sealed envelope, the deflection electrode is designed so that the incident light does not arrive at the photoelectric layer and this prevents the phosphor layer from emitting light emission.

DESCRIPTION OF THE PREFERRED EMBODIMENTS

Figure 1:
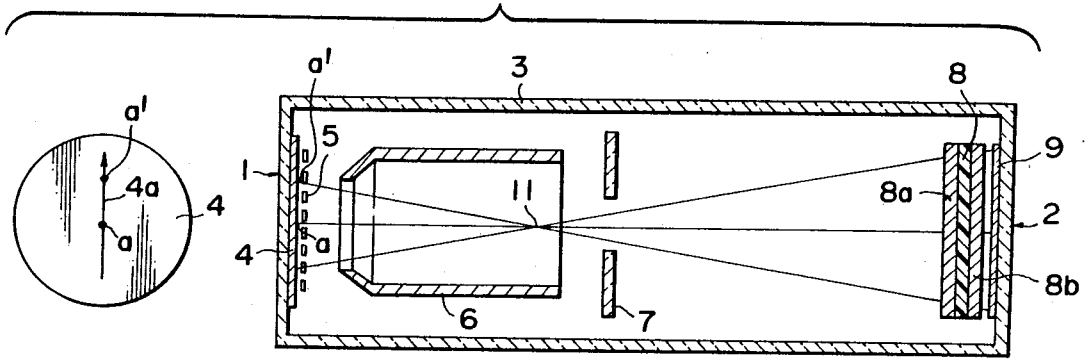
FIG. 1 shows a cross-sectional view of the configuration of the conventional imaging tube, together with the interrelation between the photoelectric layer and optical image.
Figure 3:
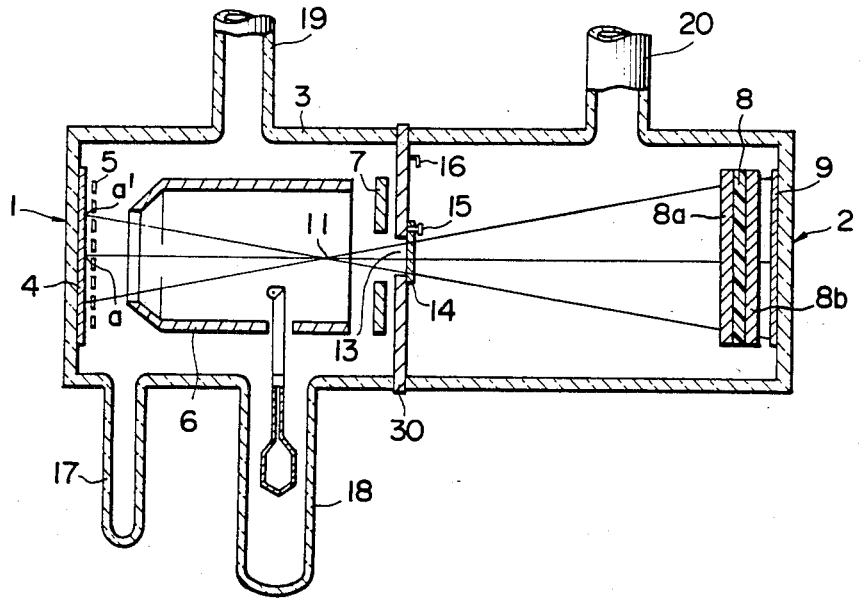
FIG. 3 shows a cross-sectional view of the imaging tube during the process of fabricating the imaging tube in accordance with the present invention.

FIG. 3 shows a sectional view of an imaging tube in the process of being fabricated in accordance with the present invention. In the figure, the numerals as in FIG. 1 indicate the same elements in the imaging tube.

First, the configuration of the imaging tube shown will be described.

In the imaging tube in accordance with the present invention, separation wall 30 divides a sealed vacuum envelope 3 into a space including photoelectric layer 4, mesh electrode 5, focusing electrode 6, and aperture electrode 7 and another space including micro-channel-plate 8 and phosphor layer 9.

Figure 2:
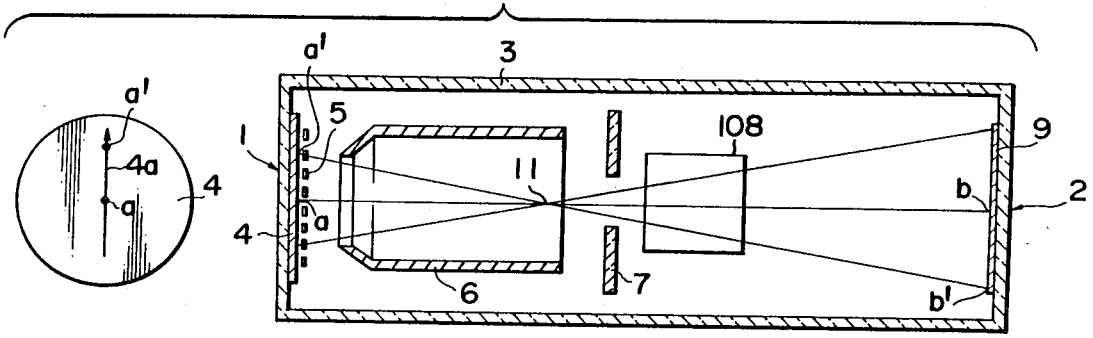
FIG. 2 shows a cross-sectional view of the configuration of the conventional streaking tube together with the interrelation between the photoelectric layer and optical image.
Figure 4:
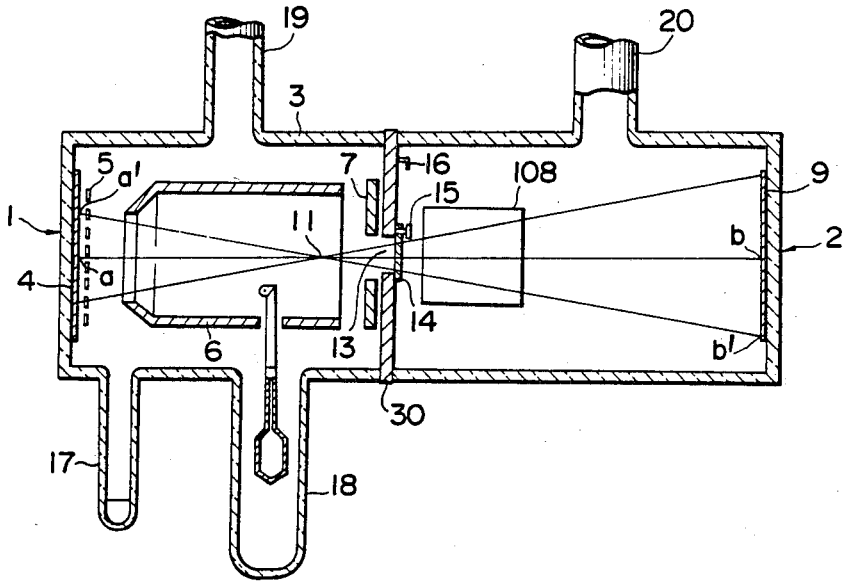
FIG. 4 shows a cross-sectional view of the streaking tube during the process of fabricating the streaking tube in accordance with the present invention.

Likewise, FIG. 4 shows a sectional view of the streaking tube in the process of being fabricated in accordance with the present invention. In this figure, the same numerals as in FIG. 2 indicate the same elements in the streaking tube.

First, the configuration of the streaking tube will be described.

In the streaking tube in accordance with the present invention, separation wall 30 divides a sealed vacuum envelope 3 into a space including photoelectric layer 4, mesh electrode 5, focusing electrode 6, and aperture electrode 7 and another space including deflection electrode 108 and phosphor layer 9.

Both in the imaging tube and the streaking tube shown in FIGS. 3 and 4, respectively, separation wall 30 provides opening 13 which can mate with a lid 14.

Figure 5A:
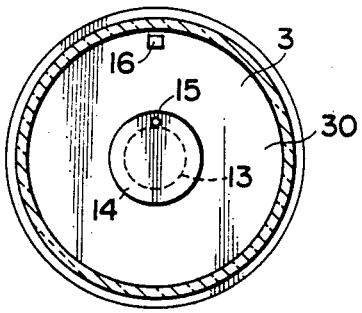
FIGS. 5A and 5B are explanatory views showing the configuration of a separation wall and lid of the tube used in the embodiments shown in FIGS. 3 and 4.
Figure 5B:
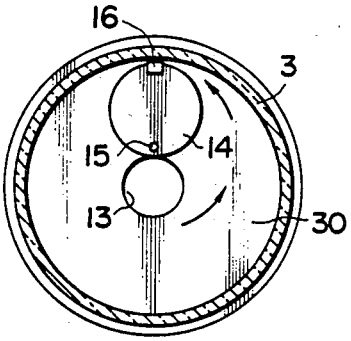

FIG. 5(A) shows lid 14 covering opening 13, and FIG. 5(B) shows lid 14 not covering opening 13.

Lid 14 is revolvable around pin 15 fastened to wall 30. Lid 14 covers opening 13 during fabrication, as shown in FIGS. 3 and 5(A), and lid 14 is clamped by leaf spring 16 fastened to separation wall 30 after the fabrication processes are completed. The center of opening 13 lies on the tube axis, and is arranged at or near crossover point 11 at which the photoelectron beam is focused.

Referring to FIGS. 3 and 4, the method of fabricating the imaging tube and the streaking tube will be described hereinafter.

Exhausting tube 19 leading to a vacuum pump, not shown, is provided in the first space wherein photoelectric layer 4, mesh electrode 5, focusing electrode 6, and aperture electrode 7 are arranged.

Exhausting tube 20 is provided in the second space, within a sealed vacuum envelope, wherein micro-channel-plate 8 in FIG. 3 or deflection electrode 108 in FIG. 4 and phosphor layer 9 are arranged.

The first and second spaces are separated by closing the opening 13 on the separation wall with the lid during fabrication.

Branching tube 17 to store alkali metal and branching tube 18 to store antimony evaporation sources are respectively connected together via the first space.

First, the respective spaces within the envelope are exhausted until a predetermined vacuum is obtained.

Second, the antimony evaporation source is taken out of branching tube 18 by means of a magnetic force. The antimony is heated by a current and evaporated onto photoelectric layer substrate 1.

Third, alkali metal evaporated from branching tube 17 is to reacted with the antimony on photoelectric layer substrate 1.

Fourth, branching tube 17 for storing the alkali metal is cut off when the maximum sensitivity is obtained on the photoelectric layer during monitoring operations.

Fifth, branching tube 18 for storing the antimony evaporation source is cut off.

Finally, the envelope is heated to stabilize the photoelectric layer. Excessive alkali metal is thus exhausted from envelope 3. Thereafter, exhausting tubes 19 and 20 are cut. Then, the imaging tube is completed.

When the imaging tube face is set down in the reverse direction after the tube is completed, lid 14 is automatically moved beneath opening 13 due to the force of gravity. One end of lid 14 is clamped by leaf spring 16 and fastened there. FIG. 5(B) shows the outside view of the lid when the tube face goes down.

Figure 6A:
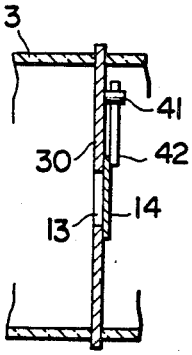
FIGS. 6A, 6B and 6C are explanatory views showing another configuration of the separation wall and lid of the tube.

FIG. 6 shows a second embodiment of the separation wall and lid of the imaging or streaking tube.

Figure 6B:
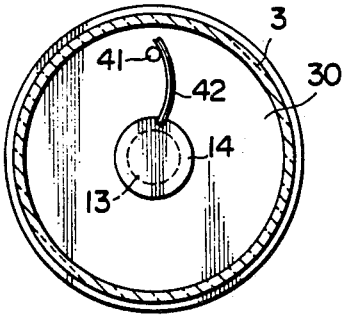
Figure 6C:
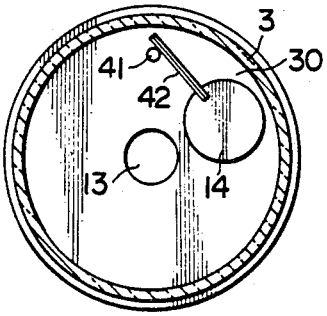

In this embodiment, lid 14 is fastened by bimetal 42 to a supporting rod arranged around separation wall 30. When the imaging or streaking tube is kept at room temperature, lid 14 does not cover opening 13. See FIG. 6(C) for details. While alkali metal is being fed to the photoelectric layer, bimetal 42 heated at about 200° C. is bent as shown in FIG. 6(B). Bent bimetal 42 causes lid 14 to cover opening 13.

Even though such configuration as described above is employed, lid 14 protects the alkali metal against thrusting into the second space.

FIG. 7 shows a third embodiment of the separation wall and lid of the tube.

Lid 14 is fastened in a revolvable way to rod 51 supported around rotation axis 50 on separation wall 30.

Figure 7A:
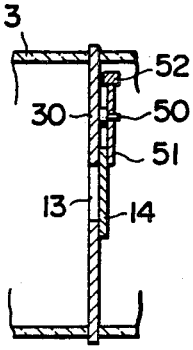
FIGS. 7A, 7B and 7C are views illustrating third configuration of the separation wall and lid of the tube.
Figure 7B:
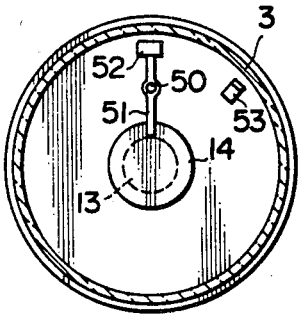
Figure 7C:
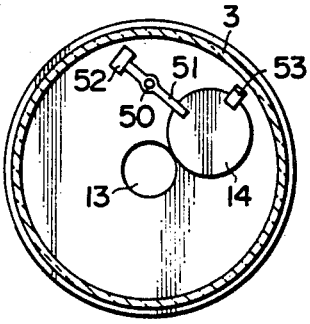

Head member 52 of a ferromagnetic material is fastened to the other end of revolvable rod 51, and is kept at the position indicated by FIGS. 7(A) and 7(B) so as to cover opening 13. Head member 52 is held at a different position where opening 13 is kept opened as shown in FIG. 7(C) by means of leaf spring 53 when an external magnetic force is applied to the head member after completion of fabrication, or when the tube is placed in a different attitude.

FIG. 8 shows a fourth embodiment of the separation wall and lid of the tube.

Figure 8A:
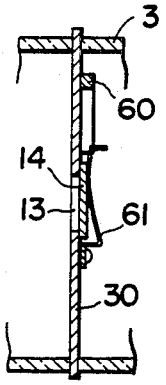
FIGS. 8A, 8B, 8C and 8D are views showing a fourth configuration of the separation wall and lid of the tube.
Figure 8B:
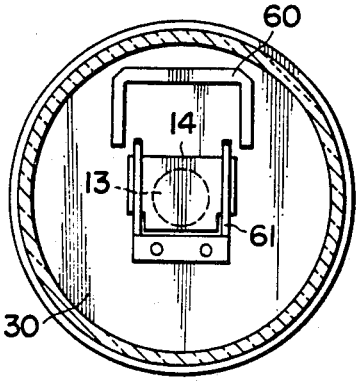
Figure 8C:
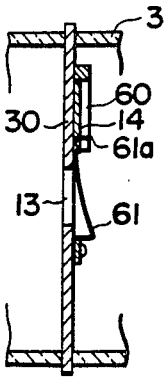
Figure 8D:
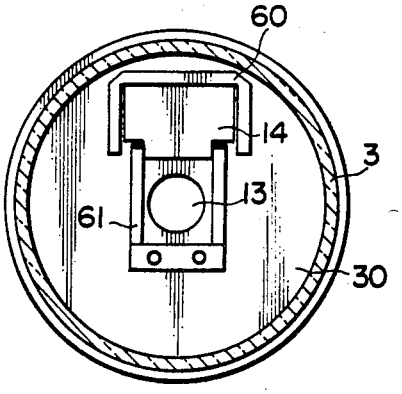

FIG. 8(A) and 8(B) depict the state of the lid during fabrication, and FIG. 8(C) depicts the state of the lid during use of the tube.

Lid 14 is attached to opening 13 of separation wall 30 by means of leaf spring 61 during fabrication. 60 indicates a frame to accept lid 14, and it can accept lid 14 after completion of fabrication. Leaf spring 16 has a claw at its tip 61a. The claw contacting the shoulder of lid 14 protects lid 14 against moving.

The imaging or streaking tube in accordance with the present invention is arranged and fabricated in such a manner as described above. Thus, alkali metal cannot be fed to the microchannel-plate or deflection electrode while the photoelectric layer is being formed. Light emission occurring in micro-channel-plate 8 or deflection electrode 108 seldom arrives at the photoelectric layer due to existence of separation wall 30 while the tube is being raised, and thus the problem of unwanted light emission can be solved by the technique in the present invention.

An image on the phosphor layer of the imaging tube fabricated in accordance with the present invention was compared with that on the phosphor layer of the imaging tube with the same dimensions fabricated in accordance with the prior art technique. The result of comparison will be described hereafter with reference to FIG. 9.

A voltage of 1.3 to 1.9 kV was applied across input electrode 8*a* and output electrode 8*b* of micro-channel-plate 8 unless light was incident upon photoelectric layer 4, and an electron current flowing into phosphor layer 9 was measured.

Figure 9A:
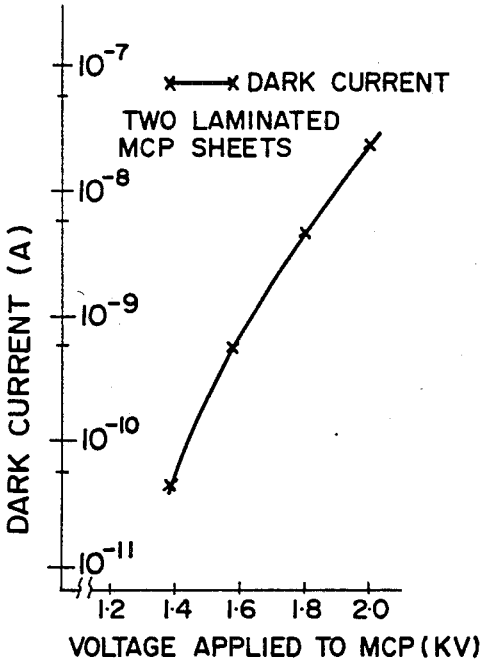
FIGS. 9A and 9B show dynamic chacteristics of the imaging tube in accordance with the present invention as compared to that for the equivalent conventional imaging tube.
Figure 9B:
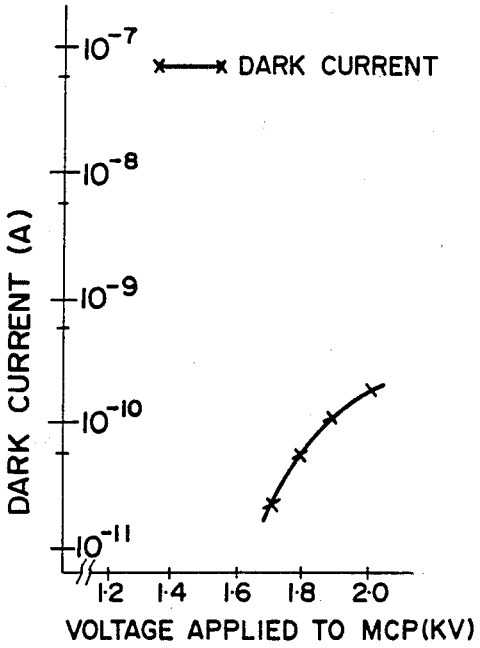

FIG. 9(B) shows a graph of dark currents for the imaging tube fabricated in accordance with the processes mentioned above, whereas FIG. 9(A) shows a graph of dark currents for the imaging tube with the same dimensions built in such a manner that the first space is not shielded from the second space.

The conventional imaging tube depicted on a graph in FIG. 9(A), had a dark current of $5\times10^{-10}$A when a voltage of 1.4 kV was applied across input electrode 8*a* and output electrode 8*b* of micro-channel-plate 8 and it had a dark current of $2\times10^{-8}$ A when a voltage of 1.9 kV was applied.

When the dark current became $10^{-9}$ A, a number of bright spots appeared over the entire surface of the phosphor layer. When the dark current became $2\times10^{-8}$ A, light emission over the entire surface of the phosphor layer became saturated and the light signal could not be displayed even though incident upon the photoelectric layer.

The imaging tube in accordance with the present invention, depicted on a graph in FIG. 9(B), had a dark current of $2\times10^{-11}$ A when a voltage of 1.7 kV was applied cross input electrode 8*a* and output electrode 8*b* of micro-channel-plate 8 and it had a dark current of $2\times10^{-10}$ A when a voltage of 1.9 kV was applied. The dark current was drastically decreased when compared to the conventional imaging tube.

The photoelectric layer of the streaking tube was irradiated by the light pulse source (of a mode lock dye laser emitting light at a frequency of 130 MHz). A sine wave voltage synchronized with the light pulse was repetitively applied to the deflection electrode.

Figure 10A:
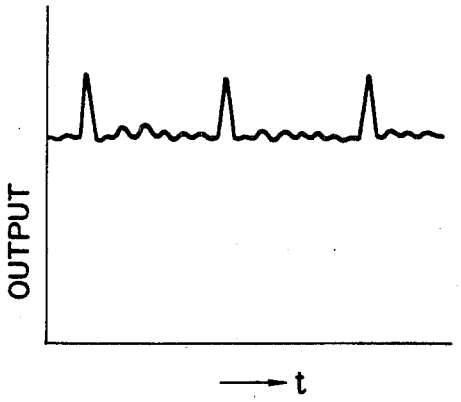
FIGS. 10A and 10B show the dynamic characteristics of the streaking tube in accordance with the present invention as compared to that for the equivalent conventional streaking tube.

FIG. 10(A) compares the output signal of the streaking tube in accordance with the present invention with that of the conventional streaking tube.

Brightness at the valley of the curve for the conventional streaking tube in FIG. 10(A), which causes the background noise, is 90% of that at its peak.

Figure 10B:
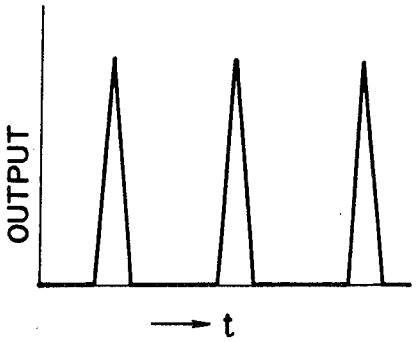

Whereas, brightness at the valley of the curve for the streaking tube in accordance with the present invention in FIG. 10(B), which causes the background noise, is 1% of that at its peak and the latter can be disregarded as compared with the former.

Although the typical imaging tube is described in the specification, the scope and spirit of the present invention covers modification of the imaging of the same type.

It is easily understood by persons skilled in the art that a two-dimensional device such as the charge coupled device (CCD) or position sensitive device (PSD) can be used in place of phosphor layer 9 to increase the S/N ratio, and that the former has the same effect on sensitivity as compared to the latter.

Furthermore, it is easily understood that alkali metal does not contaminate the internal junction of the CCD or PSD and it does not degrade its electrical performance.

What is claimed is:

1. A method of fabricating an imaging tube whose micro-channel-plate is used to multiply the photoelectrons emitted from the photoelectric layer and to observe the diminished light image comprising:

assembling process to separate first space including at least one surface to form a photoelectric layer formed within an envelope exhausted to obtain a vacuum and a focusing electrode, from second space including at least a microchannel-plate and a phosphor layer on the separation wall with an opening arranged on the tube axis so that said opening may be arranged at or near the crossover point of photoelectrons, and also to provide a lid which is being closed on said opening during fabrication;

exhausting process to exhaust said first and second spaces;

photoelectric layer forming process to form a photoelectric layer while introducing alkali metal to form said photoelectric layer via a branching tube into said first space;

ejection process to cut said branching tube, to exhaust said envelope while said envelope is being heated, and to eject photoelectric layer forming materials which do not contribute to form said photoelectric layer; and removing process to remove said lid from said opening after completion of exhausting operations.

2. A method of fabricating a streaking tube whose deflection electrode is used to deflect the photoelectrons emitted from a photoelectric layer and to observe a diminished light image comprising:

assembling process to separate first space including at least one surface to form a photoelectric layer formed within an envelope exhausted to obtain a vacuum and a focusing electrode, from second space including at least a deflection electrode and a phosphor layer on the separation wall with an opening arranged on the tube axis so that said opening may be arranged at or near the crossover point of photoelectrons, and also to provide a lid which is being closed on said opening during fabrication;

exhausting process to exhaust said first and second spaces;

photoelectric layer forming process to form a photoelectric layer while introducing alkali metal to form said photoelectric layer via a branching tube into said first space;

ejection process to cut said branching tube, to exhaust said envelope while said envelope is being heated, and to eject photoelectric layer forming materials which do not contribute to form said photoelectric layer; and removing process to remove said lid from said opening after completion of exhausing operations.

3. A method of fabricating an imaging tube wherein photoelectrons emitted from a photoelectric layer crossover the longitudinal axis of said tube at a crossover point, said imaging tube including a micro-channel-plate for multiplying photoelectrons emitted from a photoelectric layer, said method comprising the steps of:

providing an envelope having an axis coincident with said longitudinal axis;

positioning, within a first space at one end of said envelope, a substrate for deposition of said photoelectric layer thereon and a focusing electrode adjacent said substrate, within a second space at the other end of said envelope a phospher layer and said micro-channel-plate adjacent thereto, and interposing between said first and second spaces, a separation wall having a removable lid for covering an opening in said wall located adjacent said crossover point on the longitudinal axis of said envelope;

exhausting gas from the first and second spaces of said envelope;

forming a layer of photoelectric material on said substrate while introducing an alkali metal into said first space through a branching tube;

removing said branching tube after formation of said photoelectric layer;

heating said envelope to stabilize said photoelectric layer and exhausting said envelope to eject photoelectric material not contributing to the formation of said photoelectric layer; and removing said lid from the opening in said separation wall.

4. A method of fabricating a streaking tube wherein photoelectrons emitted from a photoelectric layer crossover the longitudinal axis of said tube at a crossover point, said streaking tube including a deflection electrode for deflecting photoelectrons emitted from said photoelectric layer, said method comprising the steps of:

providing an envelope having an axis coincident with said longitudinal axis;

positioning, within a first space at one end of said envelope, a substrate for deposition of a photoelectric layer thereon and a focusing electrode adjacent said substrate, within a second space at the other end of said envelope a phospher layer and said deflection electrode, and interposing between said first and second spaces, a separation wall having a removable lid for covering an opening in said wall located adjacent said crossover point on the longitudinal axis of said envelope;

exhausting gas from the first and second spaces of said envelope;

forming a layer of photoelectric material on said substrate while introducing an alkali metal into said first space through a branching tube;

removing said branching tube after formation of said photoelectric layer;

heating said envelope to stabilize said photoelectric layer and exhausting said envelope to eject photoelectric material not contributing to the formation of said photoelectric layer; and removing said lid from the opening in said separation wall.

* * * * *